United States Patent [19]

Hagen et al.

[11] Patent Number: 4,722,710

[45] Date of Patent: Feb. 2, 1988

[54] LIFE PRESERVER

[75] Inventors: Klaus Hagen, Hamburg; Heinz Milbrath, Halstenbek; Wilhelm J. Janssen, Latendorf, all of Fed. Rep. of Germany

[73] Assignee: Bernhardt Apparatebau GmbH & Co., Hamburg, Fed. Rep. of Germany

[21] Appl. No.: 937,347

[22] Filed: Dec. 3, 1986

[30] Foreign Application Priority Data

Dec. 4, 1985 [DE] Fed. Rep. of Germany ..... 8534081

[51] Int. Cl.[4] ..... B63C 9/08

[52] U.S. Cl. ..... 441/103; 2/2.1 R; 405/186; 441/88

[58] Field of Search ..... 441/88, 102, 103, 104, 441/105–110; 2/2.1 R; 405/185, 186

[56] References Cited

U.S. PATENT DOCUMENTS 3,449,761 6/1969 Long ..... 2/2.1 R
4,274,759 6/1981 Long et al. ..... 405/186

FOREIGN PATENT DOCUMENTS 3121318 12/1982 Fed. Rep. of Germany ..... 441/103
8589 1/1984 Japan ..... 441/103

*Primary Examiner*—Joseph F. Peters, Jr.
*Assistant Examiner*—Paul E. Salmon
*Attorney, Agent, or Firm*—Becker & Becker, Inc.

[57] ABSTRACT

A life vest or preserver for a person who has encountered an emergency at sea or over some other body of water. The life preserver is provided with an inflatable lifesaving collar. Provided on the life preserver, around the armholes as well about the entire lower edge, are pocket-like containers that can be closed. Arm and leg coverings are removably secured in the pocket-like containers in such a way that those parts of the arm and leg coverings that are removed from the containers can, as a protective covering, be placed about the hands, arms, feet, legs, and abdomen of the wearer, with each of these parts being provided with a zipper. Formed preferably in the foot portions of the leg coverings are slits, each of which is provided over its entire length with a closure that opens automatically under compressive load.

5 Claims, 3 Drawing Figures

2
5
3
6
6
8
8
12
12
11
11
1
3
4
4
12
12
9
9
7
7

LIFE PRESERVER

BACKGOUND OF THE INVENTION

1. Field of the Invention

The present invention relates to a life vest or preserver for a person who has encountered an emergency at sea or over some other body of water. The life preserver is provided with a lifesaving collar that is preferably inflatable. Provided on the life preserver, around the armholes as well as about the entire lower portion, are pocket-like containers that can be closed by elements that can be pulled apart. Arm and leg coverings are removably secured in these pocket-like containers in such a way that those parts that are removed from the containers when the life preserver is being worn can, as a protective covering, be placed about the hands, arms, feet, legs, and abdomen of the wearer, with each of these last-mentioned parts being provided with a zipper. Openings are formed in the foot and/or hand portions of the arm and leg coverings.

A life preserver of this type not only protects a person who has encountered an emergency at sea from drowning via the lifesaving collar, but also protects this person from overcooling. By disposing the arm and leg coverings in the pocket-like containers of the life preserver, such a life preserver can be worn in a normal situation without hindering the freedom of movement of the wearer. However, a suit that protects against cold and that is necessary in order to survive an emergency at sea is easily accessible at all times. In order to put this suit on, it is only necessary to pull the arm and leg coverings out of the pocket-like containers of the life preserver. The free ends of these coverings are expediently in the shape of shoes or gloves, thus facilitating putting them on and closing the zippers. After the zippers have been closed, which incidently can be effected even after the person is in the water, the coverings, which are still connected to the containers, form a protective covering about the hands, arms, feet, legs, and abdomen. This protective covering forms a water cushion about the body of the person that has encountered the emergency; this water cushion acts as insulation. Although it is desirable to trap a certain amount of water between the body of the person and the protective covering as insulating material, this water makes it considerably more difficult to get the person that is being rescued on board a rescue vessel, since the trapped water also has to be lifted up. In order to alleviate or remedy this drawback, openings in the form of small holes are formed in the foot and/or hand portions of the protective covering. When the endangered person is being rescued, the trapped water can escape via these holes. So that the trapped water can fulfill the insulation function assigned to it, these openings cannot be very large, since otherwise an exchange of water would take place with the surroundings. Unfortunately, however, when the person is being rescued the water flows very slowly through these small holes, thus adversely affecting the rescue procedure.

It is therefore an object of the present invention to design the part of such a life preserver that protects against cold in such a way that the water that is trapped by the protective covering as insulating material quickly escapes as the person is being rescued.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
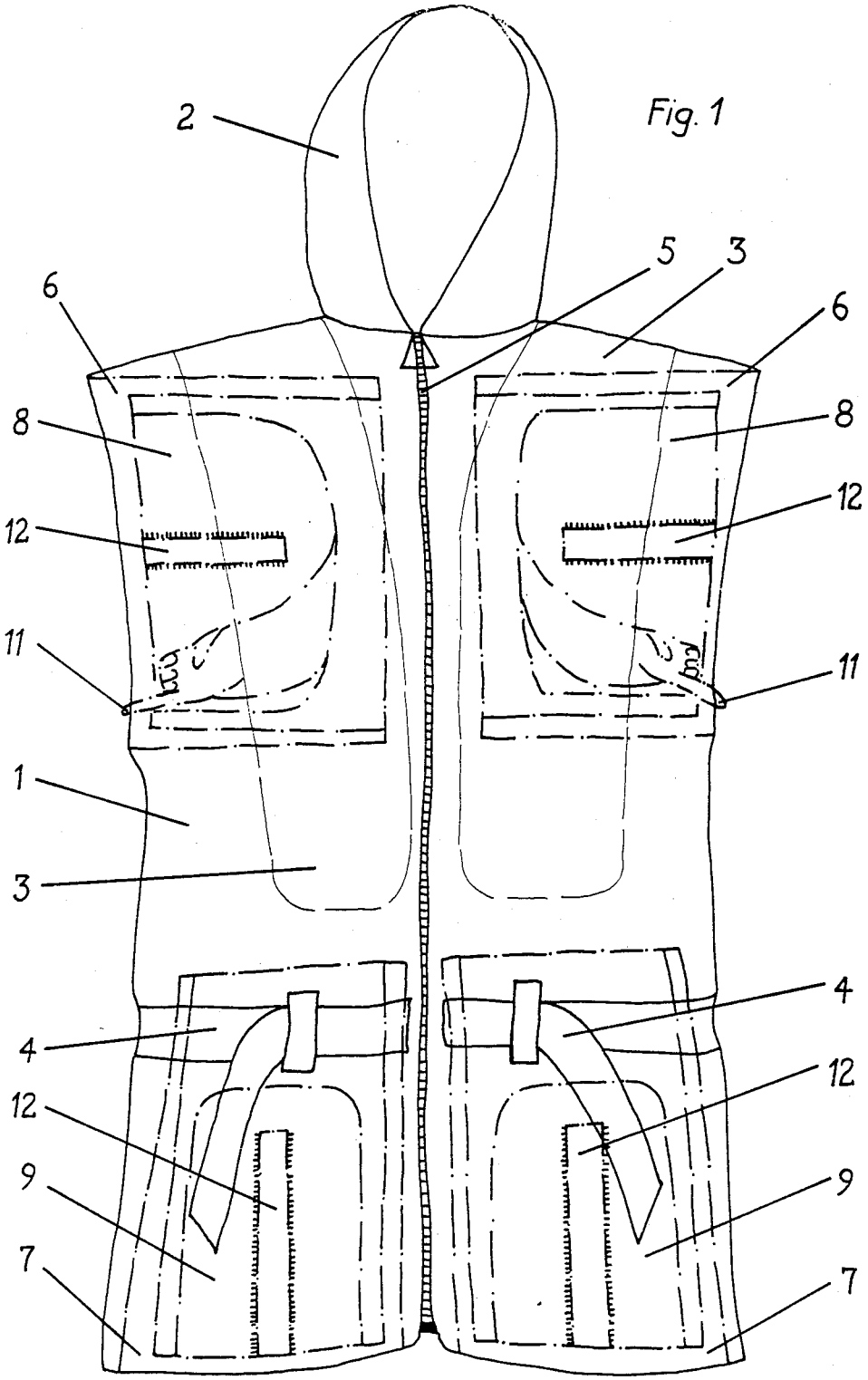
FIG. 1 is a front view of one exemplary embodiment of the inventive life preserver, which has arm and leg coverings disposed in the vest member.

The life preserver of the present invention is characterized primarily in that the openings in the foot and/or hand portions of the arm and leg coverings are in the form of slits, each of which, over its entire length, being provided with a closure means that opens automatically under compressive load.

What is achieved with the water-escape slits provided pursuant to the present invention in the foot and/or hand portions of the covering that protects against cold is that as the person that is being rescued is brought on board, the pressure of the water trapped in this covering opens the closure means of these slits (which closure means are expediently embodied as Velcro-type fasteners) in an abrupt manner, so that the water can flow rapidly out of the protective suit in seconds. There is a further advantage to the inventive embodiment of the drain openings as closeable slits, which can be disposed in the leg coverings in the vicinity of the soles of the feet, and which assure that all of the water will flow out of the protective suit. This further advantage is that as a result of these inventive openings, no exchange of water can occur with the surroundings. Such a water exchange would adversely affect the insulation effect of the water trapped by the protective covering by constantly cooling this water.

It should be noted that the slits can also be provided in the arm coverings in the region of the hand portions thereof, or could be provided in both the leg coverings and the arm coverings.

Further specific features of the present invention will be discussed in detail subsequently.

DESCRIPTION OF PREFERRED EMBODIMENTS

Referring now to the drawings in detail, the illustrated life vest or preserver comprises a vest member 1 to which is attached a hood 2. An inflatable lifesaving floating collar 3 is secured to the vest 1. To securely fasten the vest 1, and hence the collar 3, to the body of the person wearing the inventive life preserver, the latter is provided in front with a zipper 5, and is also provided with a belt 4.

Pocket-like receptacles or containers 6 and 7 on the inside of the vest 1 extend not only around the armholes, but also about the entire lower edge of the vest. One end of respective arm coverings 8 and leg coverings 9 are secured in the pocket-like containers 6 and 7 respectively; these arm and leg coverings 8, 9 are disposed in the pockets in a folded state. To prevent the arm and leg coverings 8, 9 from accidentally falling out of the pocket-like containers 6, 7, the latter are provided with respective, not-illustrated Velcro-type closures.

Figure 2:
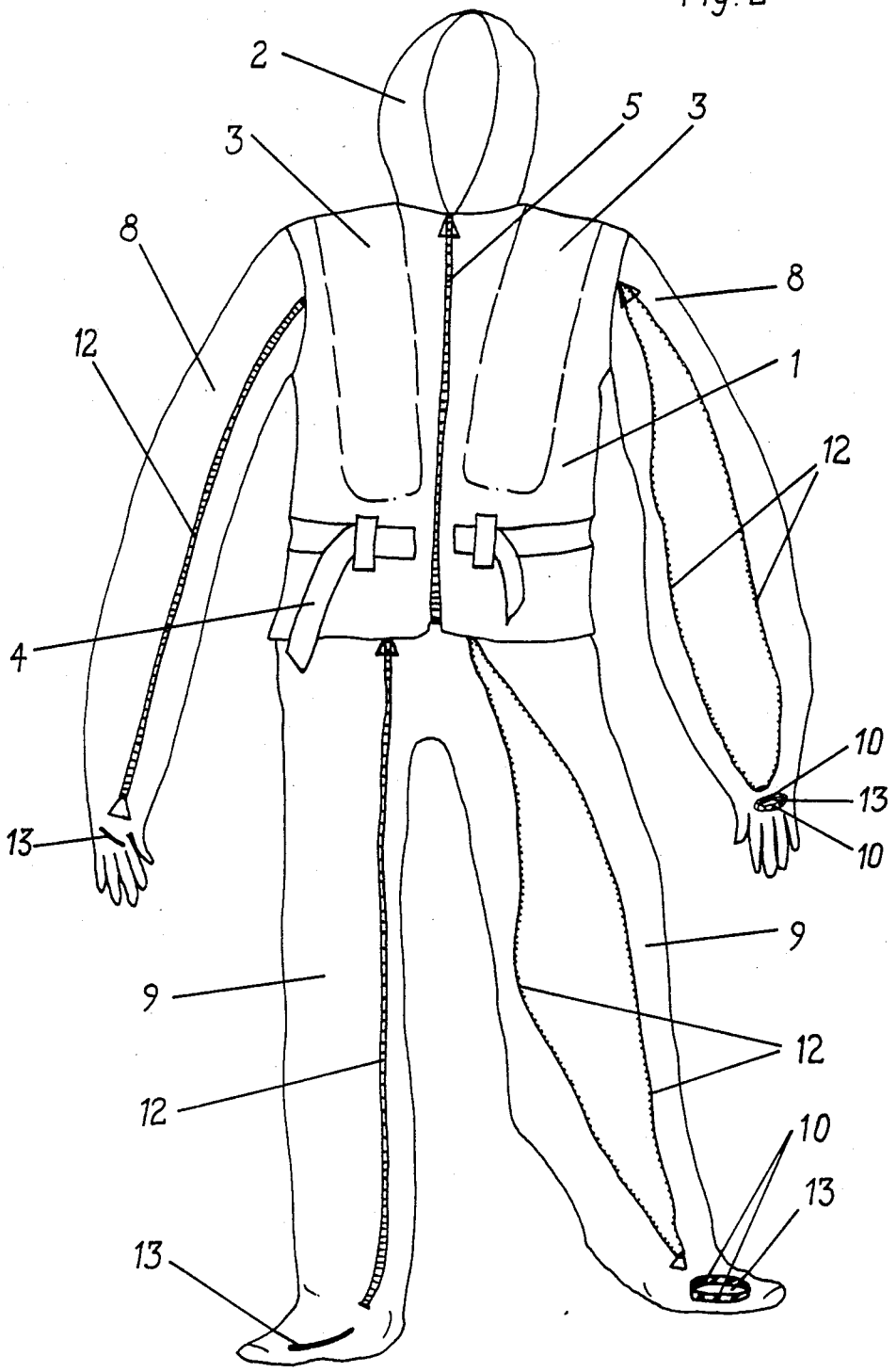
FIG. 2 is a view of the life preserver of FIG. 1 showing the arm and leg coverings pulled out of the vest.
Figure 3:
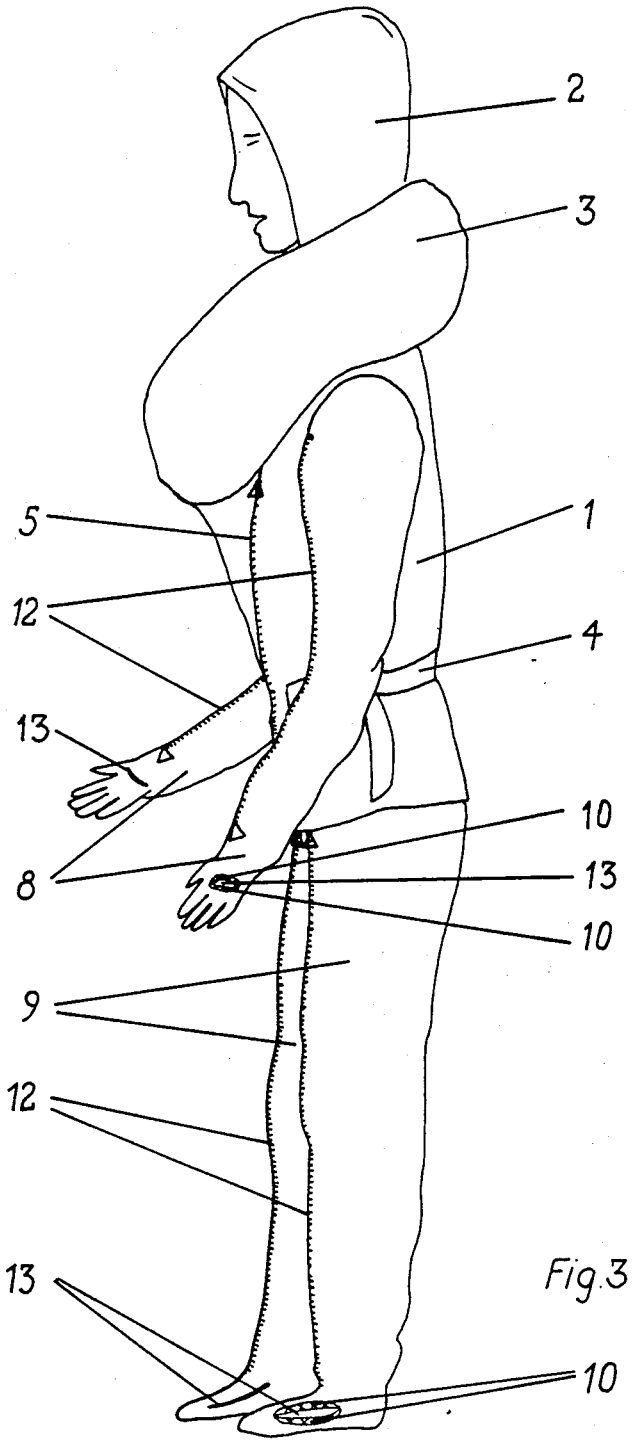
FIG. 3 is a side view showing the inventive life preserver on a person in an emergency and rescue situation.

In an emergency, the coverings 8 and 9 form a protective covering that prevents an unchecked heat exchange between the body of a person floating in water, and the water itself, thus preventing overcooling of such a person over a long period of time. As shown in FIG. 2, to put on this protective covering, the ends 11 that project out of the containers 6 and 7 (and that for ease of illustration are shown only in conjunction with the arm coverings 8 in FIG. 1), are grasped, thereby enabling the arm coverings 8 and the leg coverings 9 to be pulled out of their respective containers 6 and 7 in the vest 1 while at the same time opening the Velcro-type closures. The person's arms and legs are placed into the coverings 8 and 9 that now hang out of the vest; the pertaining zippers 12 are then closed, as a result of which,in conjuction with the vest 1 and the hood 2, there is obtained a suit that extends from head to foot, protects against cold, and is provided with a lifesaving floating collar 3 (FIG. 3).

In addition, slits 13 are formed on the sides at the foot ends of the leg coverings 9 near the soles of the feet. The slits 13 are kept closed by respective Velcro-type closure means 10 that extend over the entire length of a given slit 13. These Velcro-type closure means 10 open under the pressure of the water that has collected within the protective suit when a person is rescued, so that this water can escape from the protective suit, via the slits 13, in a very short time.

If desired, slits 13 could also be provided near the hand ends of the arm coverings 8. Such additional slits 13 would speed up the escape of water from the protective suit even more. Also, each of the closure means 10 can be in the form of a stick-type closure.

The present invention is, of course, in no way restricted to the specific disclosure of the specification and drawings, but also encompasses any modifications within the scope of the appended claims.

What we claim is:

1. In a life preserver for a person who has encountered an emergency over, on, or in a body of water, with the life preserver being provided with armholes, a lower edge and a lifesaving collar and, around the armholes as well as about the entire lower edge, pocket-like containers that can be closed, with arm and leg coverings being partially removably secured in said pocket-like containers in such a way that those parts of said arm and leg coverings that can be removed from said containers can be placed as a protective covering about the hands, arms, feet, legs, and abdomen of a wearer, with each of said last-mentioned parts being provided with a zipper and having respective hand and foot portions, the improvement wherein:

slits are formed at least in said foot portions of said leg coverings, with each of said slits being provided over its entire length with a closure means that opens automatically under compressive load.

2. A life preserver according to claim 1, in which each of said closure means is in the form of a stick-type closure.

3. A life preserver according to claim 2, in which each of said closure means is a Velcro-type closure.

4. A life preserver according to claim 3, in which each of said foot portions of said leg coverings has a sole area, with said slits being provided in the vicinity thereof.

5. A life preserver according to claim 1, in which said slits are provided in said foot portions of said leg coverings, and in said hand portions of said arm coverings.

* * * * *